United States Patent [19]

Faure

[11] Patent Number: 4,481,264

[45] Date of Patent: Nov. 6, 1984

[54] METHOD FOR CHROMIZING METALLIC PIECES SUCH AS STEEL PIECES AND CHROMIZED METALLIC PIECES OBTAINED THEREBY

[75] Inventor: André Faure, Colombes, France

[73] Assignee: Societe Anonyme Dite: Aubert & Duval, Neuilly-sur-Seine, France

[21] Appl. No.: 323,433

[22] Filed: Nov. 20, 1981

Related U.S. Application Data

[63] Continuation of Ser. No. 139,763, Apr. 14, 1980, abandoned.

[30] Foreign Application Priority Data

Apr. 20, 1979 [FR] France ..... 79 10094

[51] Int. Cl.[3] ..... C23C 9/10; C23C 9/16

[52] U.S. Cl. ..... 428/627; 148/6.3; 148/16.6; 148/31.5; 427/253; 427/319; 428/667

[58] Field of Search ..... 427/252, 253, 319, 318, 427/328, 405, 419.1, 419.7; 428/457, 335, 472, 336, 627, 667; 148/31.5, 16.6, 6.3

[56] References Cited

U.S. PATENT DOCUMENTS

| | | | |
|---|---|---|---|
| 2,437,249 | 3/1948 | Floe | 148/16.6 |
| 3,152,007 | 10/1964 | Perrin et al. | 427/253 |
| 3,205,153 | 9/1965 | Casper | 204/37 |
| 3,222,212 | 12/1965 | Samuel et al. | 427/253 |
| 3,256,818 | 6/1966 | Berghaus | 102/507 |
| 3,282,746 | 11/1966 | Zlotek et al. | 427/252 |
| 3,414,428 | 12/1968 | Kelly et al. | 427/253 |
| 3,892,597 | 7/1975 | Lincoln et al. | 148/31.5 |
| 4,042,426 | 8/1977 | Beiser | 148/31.5 |

FOREIGN PATENT DOCUMENTS

| | | |
|---|---|---|
| 1012401 | 7/1952 | France . |
| 60539 | 11/1954 | France . |
| 60686 | 11/1954 | France . |
| 1555534 | 1/1969 | France . |
| 95448 | 11/1970 | France . |
| 2031373 | 11/1970 | France . |

OTHER PUBLICATIONS

"Predissociation and Dissociation of the $N_2$ Molecule" A. E. Douglas & G. Herzberg, Canadian J. of Physics, vol. 29, pp. 294–300, 1951.

Soviet Inventions, Illustrated, Jun. 1966, Abstract–USSR Patent 176,152 of Oct. 26, 1965–Metallurgy (7), p. 8.

The Transactions of the American Society for Steel Treating, vol. XVI, No. 5, Oct. 1929, pp. 20–21, 74–75.

M. B. Bever and C. F. Floe, Casehardening of Steel by Nitriding, pp. 2–7, Dept. of Metallurgy, M.I.T.

"Nouveau Traite de Chemie Minerale", R. Dubrisey and P. Pascal, vol. X, 1956.

*Primary Examiner*—Sadie L. Childs

*Attorney, Agent, or Firm*—Fitzpatrick, Cella, Harper & Scinto

[57] ABSTRACT

The invention relates to a method for chromizing metallic pieces such as steel pieces and to chromized metallic pieces obtained thereby, said metallic pieces, particularly steel, comprising a chromized surface layer with a hardness at least equal to 1200 Vickers degrees and a thickness at least equal to 12 microns as well as an adjacent sub-layer with a hardness less than that of the core of said piece. The chromized surface layer has a depth preferably at least equal to 20 microns, more preferably 30 microns, and the hardness of the sublayer presents a maximum variation of 25 Vickers degrees with respect to that of the core of said piece.

10 Claims, 4 Drawing Figures

Figure 1:
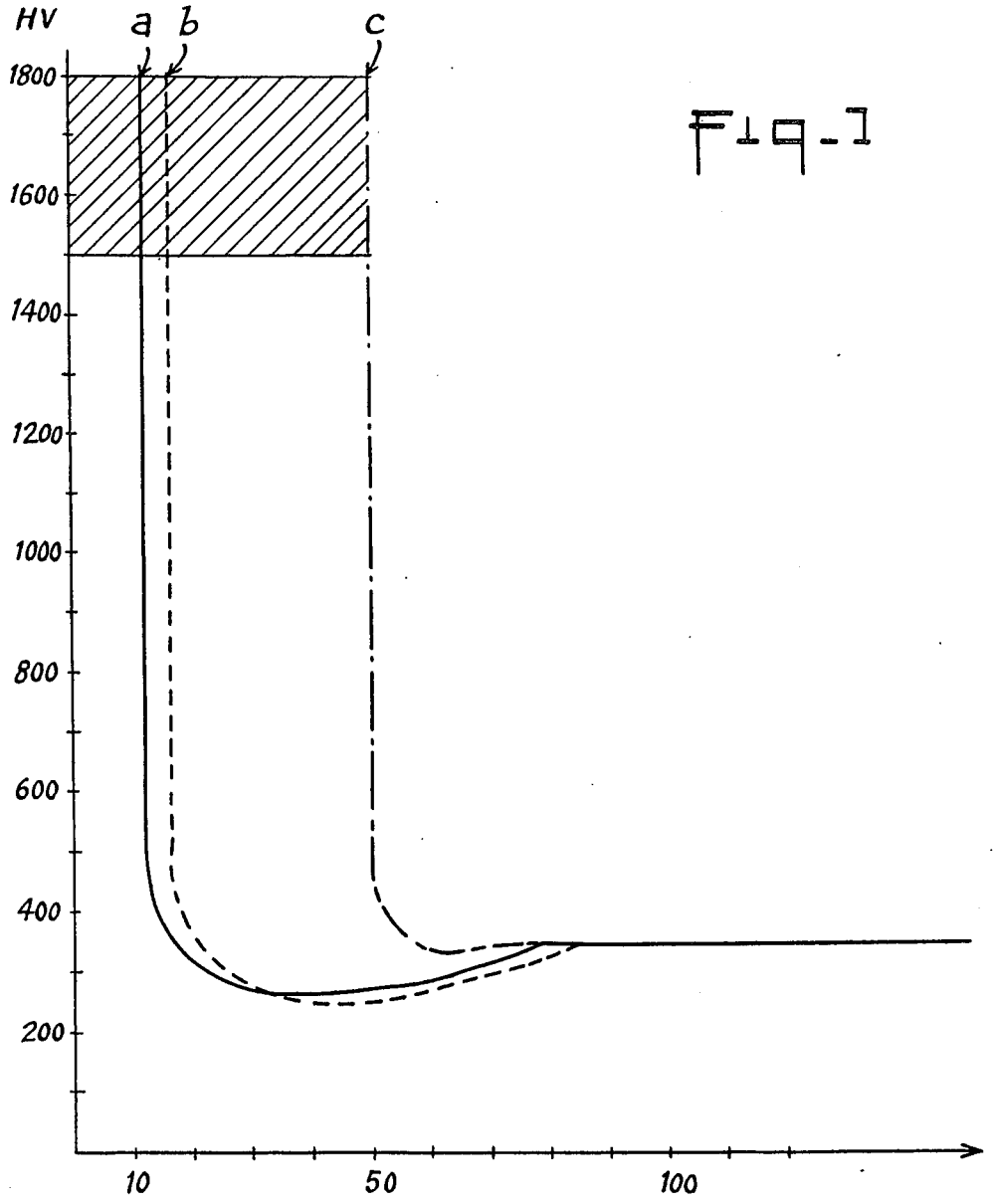

METHOD FOR CHROMIZING METALLIC PIECES SUCH AS STEEL PIECES AND CHROMIZED METALLIC PIECES OBTAINED THEREBY

This is a continuation of application Ser. No. 139,763, filed Apr. 14, 1980 abandoned.

The present invention relates to a method for chromizing metallic pieces such as pieces of steel, and to chromized metallic pieces obtained thereby.

The invention relates to a method for chromizing metallic pieces such as pieces of steel, of the type whereby chromium is diffused with a view to obtaining a superficial layer of chromium and whereby the chromium is deposited by the decomposition in gaseous phase of chromium halides, the decomposition of the halide and the diffusion of the chromium in the steel being effected simultaneously by heating the pieces to temperatures not exceeding 1300° C., in the atmosphere of halide, the actual chromizing operation being preceded by a surface deposit of nitrogen.

The actual chromizing is known, for example, by the works of Dr. Galmiche and by the ONERA French Pat. No. 1 012 401 and two Additions 60 539 and 60 686.

The application of these known methods for treatment to the surface of mild steel leads to obtaining surface layers with a high chromium content which have the advantage of being stainless but do not have high degrees of hardness.

This is "light" chromizing which finds application in the domain of inoxidability.

Due to this type of chromizing method, progressively deeper or thicker layers are obtained without difficulty by simply increasing the duration of the cycle of treatment, therefore of the diffusion time of the chromium.

The application of these same known treatments to the surface of steels containing carbon also leads to the obtaining of surface layers with a high chromium content. However, this time, in the surface layer, the chromium also combines with the carbon to give chromium carbides which give the surface layer a considerable hardness in addition to its inoxidability. This is a "hard" chromizing which finds application in the domain of steels having to have a resistance to wear possibly combined with the inoxidability of said steels.

However, in this type of hard chromizing, if it is desired to obtain, as before, progressively deeper layers simply by increasing the duration of the cycle of treatment, the following drawbacks are encountered:

(a) the chromium-carbon affinity being considerable, a stable chromium carbide layer forms in the first hours of the cycle of treatment, which layer rapidly forms a sort of screen which considerably hinders or prevents the absorption of the chromium by the steel and consequently the increase in the treatment time virtually no longer increases the depth of diffusion of the chromium, i.e. the thickness of the chromized layer.

(b) the speed of diffusion of the carbon in the steel being greater than that of the chromium, it is observed, on the contrary, that the increase in the treatment time causes a "pumping" of the carbon from the basic steel by the surface chromium, thus resulting in the formation of a decarburized steel layer immediately below the chromized layer. The presence of this decarburized sub-layer is often a hindrance for the mechanical holding of the surface layers undergoing considerable stress, as the mechanical strength of the decarburized steel is much reduced.

(c) the depth of diffusion could be increased by the increase in the chromizing temperature, if this were not limited by the problem of growth of the grain of the sub-jacent steel, the drawback of which is that it renders the sub-layer fragile, this being detrimental in certain applications in which the chromized pieces are subjected to high mechanical stresses.

In the present state of the art, and in the domain of hard chromizing, it is thus very difficult to go beyond the depth of about fifteen microns, for the surface layer effectively hardened beyond a hardness of the order of 1200, and preferably 1400 Vickers degrees. This minimum limit of hardness depends, moreover, on the effective chemical composition of the steel to be treated.

It has already been proposed to provide a surface deposit of nitrogen before the chromizing operation (cf. for example French Pat. No. 1 410 647 or the corresponding U.S. Pat. No. 3,282,746). The conditions of this prior treatment (temperature higher than the critical temperature and duration less than 2 hours—presence of carbon in the treatment gases) do not make it possible to obtain a hard chromized surface layer of a thickness greater than 20 microns. In addition, according to the known process, the nitrides present in the surface layer remain isolated in the form of an intermediate strip.

It is an object of the present invention to propose a method of hard chromizing, of the abovementioned type, enabling pieces of steel to be obtained which possess a hard chromized surface layer comprising carbonitrides, said layer being of a thickness greater than at least 20 microns, and preferably 30 microns, and a sub-layer with fine grains and sparingly or not decarburized.

This object is attained in that, prior to the actual chromizing operation, the introduction of the nitrogen in the surface layer of the metallic piece is effected so that the nitrogenous surface layer presents a nitrogen content greater than 0.8% over a depth or thickness at least equal to 0.5 mm.

Due to the invention, hard chromized layers comprising carbo-nitrides instead of separate carbides and/or separate nitrides, are then obtained after the actual chromizing operation, these layers being of a thickness greater than at least 20 microns and presenting a high resistance to wear.

Applicants' experience has led to demonstrating the beneficial influence of nitrogen:

on the one hand, on the chromium-carbon affinity and consequently on the speed of formation of the chromium carbide even leading, for a sufficient nitrogen content, to the formation of chromium carbo-nitrides instead of chromium carbides and, on the other hand, on the respective speeds of diffusion of the carbon and chromium in the steel and, furthermore, on the kinetics of growth of the grain of the steel.

Consequently, the presence of nitrogen in the surface layers of the pieces of the steel makes it possible to make a different balance of the chromium and carbon elements with respect to the basic steel during the chromizing reaction, this different balance thus making it possible to obtain much deeper chromized surface layers without producing noticeably decarburized sub-layers and without increasing the grain in the sub-layer.

The introduction of the nitrogen in the surface layers of the steel pieces to be chromized leads to a sort of activation of said layers.

The surface introduction of nitrogen may be effected by heating the piece to be treated to a temperature of between 400° and 800° C. and in any case to a temperature lower than the lower critical point of the treated steel, and for durations of between 12 and 150 hours in a nitrogen-producing medium which, by way of example, may be constituted by melted nitrous salts, ammonia or nitrogen gases, ionized or not.

This technique is fairly similar to the conventional nitriding techniques but the optimal temperatures and durations of heating must be chosen as a function of the grades of steel in question and especially as a function of the subsequent effect expected during the final chromizing phase.

In fact, superficial introductions too lean in nitrogen would not have sufficient action either on the depth of the chromized layer, nor on the formation of the chromium carbo-nitrides and too superficial introductions of nitrogen could effectively act favourably on the depth of the actual chromized layer, but would not have the expected action on the decarburization and growth of the grain of the sublayer.

It is therefore important to prepare nitrogenous surface layers previously comprising a nitrogen content higher than 0.8% over a depth at least equal to 0.5 mm. Nitrogenous surface layers are preferably prepared having a nitrogen content of between 1 and 2% over a depth of 0.5 to 1.0 mm. On a steel of type 32 CDV 13, such satisfactory nitrogenous layers may be obtained by cycles of treatment in an atmosphere of ammonia of 24 hours at 700° C. or 90 hours at 560° C.

This introduction of nitrogen may be effected:

either by an operation conducted in a separate installation and prior to the actual chromizing operation, with a cooling of the piece to be treated between the surface introduction of nitrogen and said chromizing operation, or in the actual chromizing installation, during a initial phase intended only for the introduction of nitrogen and followed by the actual chromizing cycle.

During the final chromizing phase, the atmosphere of chromium halide is in accordance with the known technique, the parameters of temperature and duration of maintenance may be in accordance with the known technique, but they may also be modified as a function of the prior introduction of nitrogen, with respect to what they would be on the same non-"activated" steel according to the present invention. In particular, the chromizing temperatures may be reduced in order to limit the growth of the grains of the sub-layer.

Two different mechanisms should, in fact, be distinguished, both beneficial to the fineness or smallness of the grains:

(1) In the near sub-layer, and more precisely at a depth of the order of a millimeter, the effective presence of nitrogen has for a direct effect to obtain a much finer grain for an equal chromizing temperature.

(2) In the deep sub-layer, and more precisely in the core of the pieces of steel, there is no presence of nitrogen and the growth of the grains could occur as in a known chromizing operation. However, insofar as the invention enables the chromizing to be effected at lower temperature, the indirect effect of this is to cause a weaker growth of grain.

After chromizing, the steel pieces may preferably undergo a heat treatment of regeneration with a view to reducing the growth of grain and to improving the resilience of the basic steel.

By way of example, the accompanying drawings indicate the comparison of the chromized layers obtained on the same grade of steel 32 CDV 13 (AFNOR) by the known chromizing techniques with or without prior activation by nitrogen and in the three cases followed by a heat treatment of regeneration of the grain by heating in vacuo, hardening and tempering.

Figure 2:
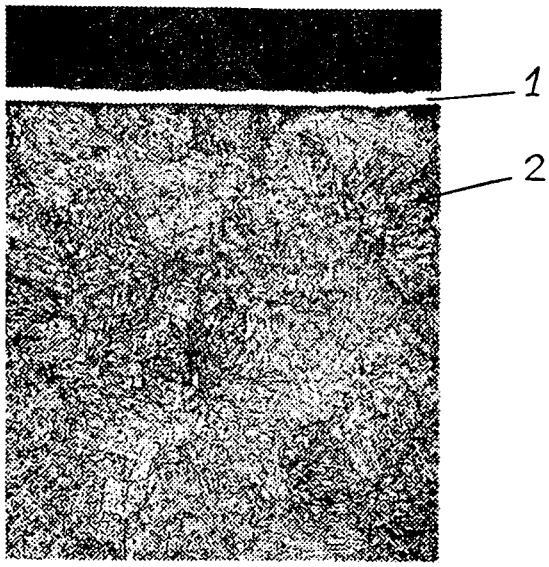
Figure 3:
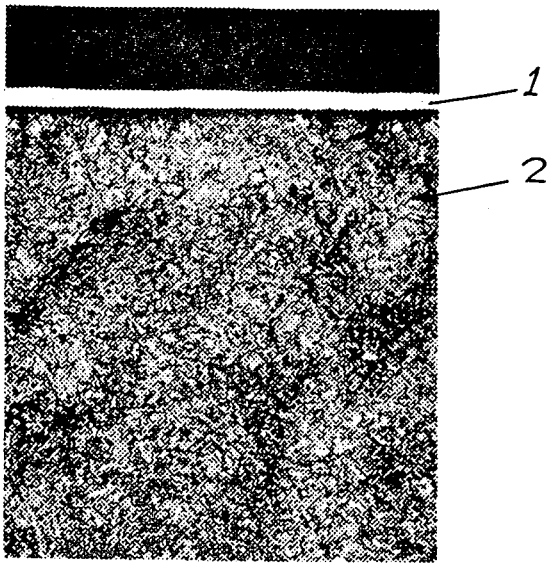
Figure 4:
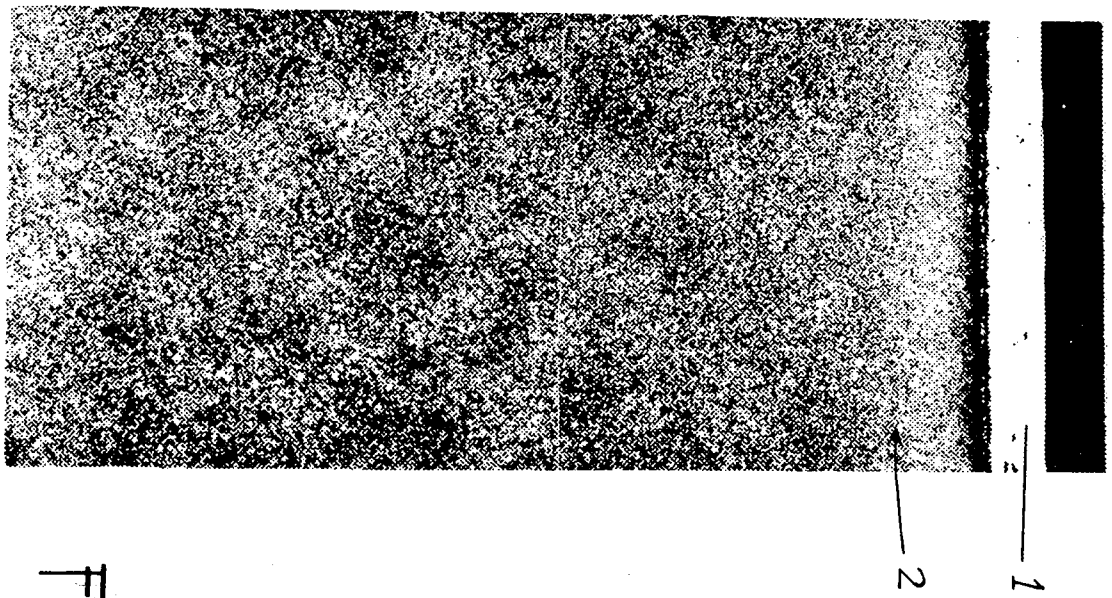

In the accompanying drawings, FIG. 1 is a microhardness diagram showing, for the grade of steel 32 CDV 13 (AFNOR), three examples of chromized steel pieces, and FIGS. 2 to 4 show microphotos of the surface layer and the adjacent sub-layer of these three examples of chromized steel pieces, the growth factor being 200 in the three cases.

In FIG. 1, the y-axis indicates the hardness of different levels of the pieces of steel, said hardness measured in Vickers degrees and the x-axis indicates the thickness or depth of the layers in microns from the surface of the piece of steel in question.

In this Figure, the solid line curve a represents the hardness of a piece of steel in Vickers degrees as a function of the depth of the level in question. This piece of steel whose transverse structure is illustrated in FIG. 2 has not undergone prior activation by nitrogen, but only a chromizing operation of 12 hours at 940° C.

It is observed that the chromized surface layer 1 has a depth or thickness of 12 microns and has a Vicker hardness greater than 1500 degrees and reaching more than 1800 degrees. On passing from the chromized surface layer 1 towards the heart or core of the piece of steel, a sub-layer 2 is penetrated, whose Vickers hardness reduces rapidly to a minimum value of 260, then rises slowly up to the Vickers hardness at the core of the piece of steel, which hardness has a value of the order of 350 and is attained at a depth of 77 microns. The thickness of this sub-layer or decarburizing zone 2 is of the order of 65 microns, this being more than 5 times the thickness of the chromized surface layer 1 and the minimum hardness of the sub-layer 2 is only about ¾ of the Vickers hardness at the core of the piece of steel. The decrease in the hardness of the sub-layer with respect to that of the core of the piece of steel clearly shows the extent of the decarburized zone and the detrimental influence of the inevitable pumping of carbon during the known chromizing operation. FIG. 2 also shows that the grain growth in the sub-layer is considerable (Afnor index 4).

The curve b of FIG. 1 shows the hardness of a piece of steel of the same grade mentioned above without activation by nitrogen, also subjected to a chromizing operation for 12 hours, but at a higher temperature, namely 980° C. This temperature increase takes the depth of the chromized surface layer 1 to 16 microns, but on the other hand the corresponding structure illustrated in FIG. 3 shows a grain growth which is even greater and more unfavourable (Afnor index 3) than that of the structure shown in FIG. 2 and the microhardness diagram shows at the bottom of the curve b between a depth of 16 microns and of 85 microns (sub-layer 2) a zone of decarburation even deeper and more intense (minimum Vickers hardness 240 degrees) than that of the example of curve a and FIG. 2. Here the Vickers hardness of the sub-layer 2 is of the order of ⅔ of the Vickers hardness at the core of the piece of steel and the sub-layer 2 with its decarburized zone has a thickness at least four times more than that of the chromized surface layer 1.

The curve c of FIG. 1 corresponds to a piece of steel having undergone the prior activation by the superficial introduction of nitrogen in accordance with the present invention (cycle of treatment of 90 hours at 560° C.). This curve c of FIG. 1 shows the Vickers hardness of a piece of steel of the same grade as the preceding examples, but is obtained after the same cycle of chromizing as the example of curve a, viz. 12 hours at 940° C. As may be seen in FIGS. 1 and 4, the chromized layer 1 has a depth of 50 microns. The structure illustrated in FIG. 4 further shows the fineness of the grain obtained in the sub-layer 2 over a depth of 1 mm and the microhardness diagram (FIG. 1) shows for the curve c a zone of decarburation much less thick (20 to 30 microns) and less intense (minimum Vickers hardness about 330 degrees) than on the two preceding examples.

It will be noted that, in the case of the example according to the invention, the thickness of the decarburized zone is very little, is less than that of the chromized layer 1 and is only approximately equal to half that of said chromized layer 1. As to the hardness of the decarburized zone of the sub-layer 2, it is at least equal to about 95% of the hardness of the core of the piece of steel. In other words, the loss of hardness in the sub-layer with respect to the basic steel at the core of the piece of steel is less than 25 Vickers degrees and affects a sparingly decarburized zone of a thickness less than 25 microns. Here, the grain is very fine in the sub-layer 2, this grain fineness being at least equal to or greater than Afnor index 6 (index 7) over a thickness at least equal to 0.5 mm (1 mm).

As mentioned previously, it is important for the steel containing carbon and intended for hard chromizing to have a surface layer containing at least 0.8% of nitrogen over a depth greater than 0.5 mm. It has been observed that, insofar as the content of nitrogen of the surface layer before chromizing exceeds 0.8% over a depth of 0.5 mm, a residual nitrogen content is found after said chromizing in the sub-layer, which is greater than 0.4% over a depth greater than 0.5 mm, this nitrogen content preventing a considerable decarburation and an appreciable growth of the grain of the sub-layer.

In addition, when the nitrogen content of the surface layer of the steel is, before chromizing, greater than 0.8% over a depth greater than 0.5 mm, the presence of chromium carbo-nitrides is found after said chromizing in the chromized surface layer, whose nitrogen content is greater than 2%.

Furthermore, in all cases, a sub-layer is found which, over a thickness at least equal to 1 mm, presents a fine grain of Afnor index equal to or greater than 7.

The invention relates not only to the new method of hard chromizing, but also to the pieces of steel treated with nitrogen with a view to chromizing, as well as to the pieces of steel chromized according to the present method and having a hard chromized surface layer of a depth at least equal to 20 microns and having a Vickers hardness at least equal to 1200 degrees.

What is claimed is:

1. A method for hard chromizing a steel piece to produce a chromized surface layer comprising chromium carbo-nitrides and having a hardness of at least 1200 VICKERS degrees and a depth of at least 12 microns, said method comprising a first step of introducing nitrogen into a surface layer of the steel piece to produce a nitrogenous surface layer having a nitrogen content greater than 0.8% over a depth of at least 0.5 mm by heating the steel piece for a period of time of 12 to 150 hours to a temperature which is both between 400° C. and 800° C. and lower than the lower critical point of the steel piece being treated, in a nitrogen producing medium; and a second step of diffusing chromium into said nitrogenous surface layer by the decomposition in a gaseous phase of chromium halides, wherein the decomposition of the halides and the diffusion of the chromium into the steel is effected simultaneously by heating said piece to a temperature not exceeding 1300° C. in the halide atmosphere.

2. The method of claim 1, wherein the introduction of nitrogen in the steel piece is immediately followed by the actual chromizing operation.

3. The method of claim 1 wherein, after the introduction of nitrogen, the steel piece is left to cool before being subjected to the actual chromizing operation.

4. A hard-chromized steel piece comprising a steel piece having a hard chromized surface layer comprising chromium carbo-nitrides and having a hardness of at least 1200 Vickers degrees and a depth of at least 12 microns and an adjacent sub-layer having a hardness lower than that of the core of said piece, wherein the maximum variation of the hardness of said sub-layer is 25 Vickers degrees with respect to that of the core of said piece.

5. The steel piece of claim 4, wherein the presence of chromium carbo-nitrides in the chromized surface layer corresponds to a minimum nitrogen content at least equal to 2%.

6. The steel piece of claim 4 including a sub-layer having a decarburized zone, wherein the thickness of the decarburized zone is less than the depth of the chromized surface layer.

7. The shell piece of claim 6, wherein the decarburized zone has a thickness less than 30 microns.

8. The steel piece of claim 4, wherein the sub-layer presents a fine grain of Afnor index of at least 6 over a thickness of at least 0.5 mm.

9. The steel piece of claim 4, wherein the residual nitrogen content in the sub-layer is higher than 0.4%.

10. The steel piece of claim 9, wherein the sub-layer presents residual nitrogen over a thickness greater than 0.5 mm.

* * * * *